United States Patent [19]

Perrott

[11] 4,331,419

[45] May 25, 1982

[54] STORAGE SYSTEM FOR CARGO CONTAINER TRAILERS

[75] Inventor: Lynn F. Perrott, Portland, Oreg.

[73] Assignee: Scott S. Corbett, Jr., Portland, Oreg.

[21] Appl. No.: 142,042

[22] Filed: Apr. 21, 1980

[51] Int. Cl.[3] ..... B66F 9/14

[52] U.S. Cl. ..... 414/283; 414/668

[58] Field of Search ..... 414/253, 255, 256, 281, 414/282, 283, 629, 642, 659, 660, 663, 664, 667, 668, 671, 495; 280/6 R, 6 H

[56] References Cited

U.S. PATENT DOCUMENTS

| | | | |
|---|---|---|---|
| 3,199,696 | 8/1965 | Chrysler et al. | 414/495 |
| 3,439,927 | 4/1969 | Ryskamp | 280/6 R |
| 3,486,653 | 12/1969 | Alstedt | 414/668 |
| 3,526,327 | 9/1970 | Atwater | 414/282 |
| 3,695,463 | 10/1972 | Weisker et al. | 414/281 X |
| 3,836,031 | 9/1974 | Weisker et al. | 414/668 |
| 4,189,276 | 2/1980 | Shaffer | 414/659 |
| 4,236,591 | 12/1980 | Molby | 280/6 H X |

*Primary Examiner*—James L. Rowland
*Attorney, Agent, or Firm*—Oliver D. Olson

[57] ABSTRACT

A storage structure is provided with a plurality of vertically, horizontally and longitudinally spaced support pads which form a plurality of vertically and horizontally spaced, elongated floors for supporting a plurality of cargo container trailers. The longitudinal passageway between adjacent horizontally separated floors freely receives a pair of vertically telescoping stabilizer masts mounted upon a powered vehicle, the front and rear wheels of one side of which are receivable in a longitudinal vehicle guide at the bottom of the storage structure. The upper ends of the masts are receivable in a longitudinal mast guide at the top of the storage structure, whereby the masts are supported in vertical position. An elevator, movable vertically between the masts and horizontally through the longitudinal passageway, is arranged to pick up a cargo container trailer and elevate it to and lower from a desired one of the floors of the storage structure.

8 Claims, 6 Drawing Figures

STORAGE SYSTEM FOR CARGO CONTAINER TRAILERS

BACKGROUND OF THE INVENTION

This invention relates to cargo container trailers of the wheeled type that are releasably connected to a tractor, as by a fifth wheel coupling, for movement over the highways, and more particularly to a system for storing such trailers when not in transit.

It is the prevailing practice to store such trailers in rather random fashion, at the loading and unloading sites of truck and railroad terminals. Because of the large size of such trailers and the large numbers of them involved in the transport of goods, those not in transit at any given location take up excessive amounts of valuable space and present obstructions there to the normal movement of traffic. Moreover, being scattered at random in such manner in areas generally accessible to the public, they are easily stolen.

SUMMARY OF THE INVENTION

In its basic concept, this invention provides a cargo container storage system in which a storage structure is provided with vertically spaced pairs of floors separated horizontally to accommodate longitudinal movement therebetween of a vehicle-mounted vertical mast stabilized at its upper end by a mast guide fixed to the storage structure, the vehicle also mounting trailer support mechanism for elevating a trailer to and lowering it from the storage floors.

It is by virtue of the foregoing basic concept that the principal objective of this invention is achieved; namely to overcome the aforementioned disadvantages and limitations of prior trailer storage procedures.

Another object of this invention is the provision of a storage system of the class described which is compact in construction, providing for the storage of a large number of trailers in a minimum of space.

A further object of this invention is the provision of a storage system of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
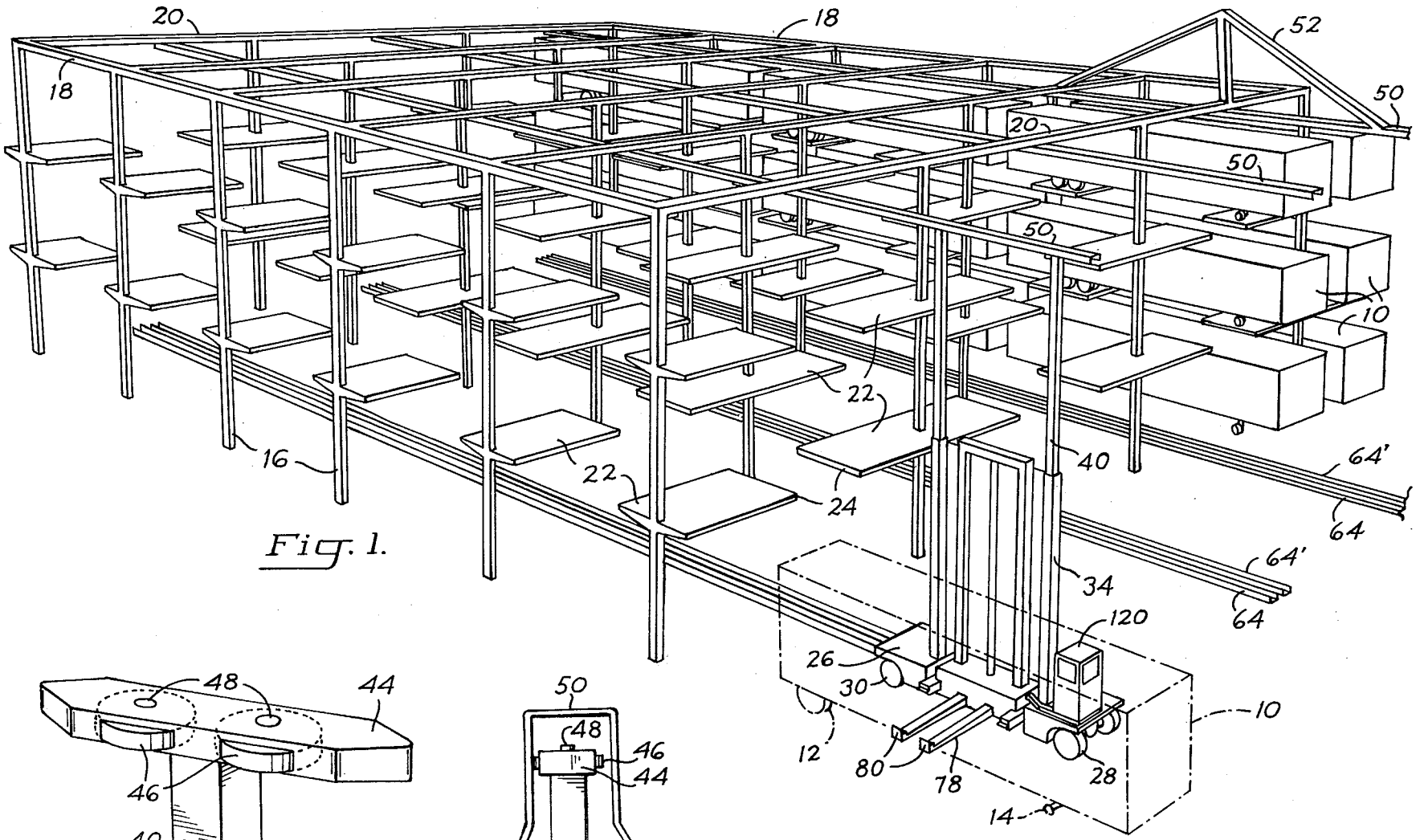
FIG. 1 is a fragmentary perspective view of a trailer storage system embodying the features of this invention.
Figure 2:
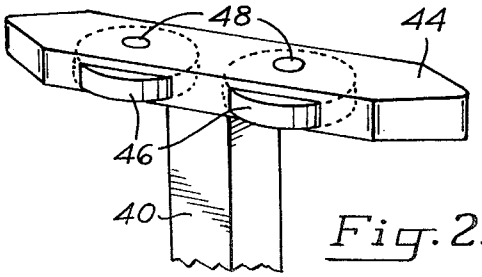
FIG. 2 is a fragmentary perspective view of the upper portion of one of the mast elements of the mobile elevator component of the system of this invention.
Figure 3:
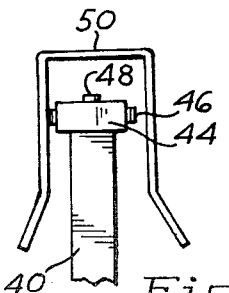
FIG. 3 is a fragmentary end elevation of the mast guide and mast guide housing components.
Figure 4:
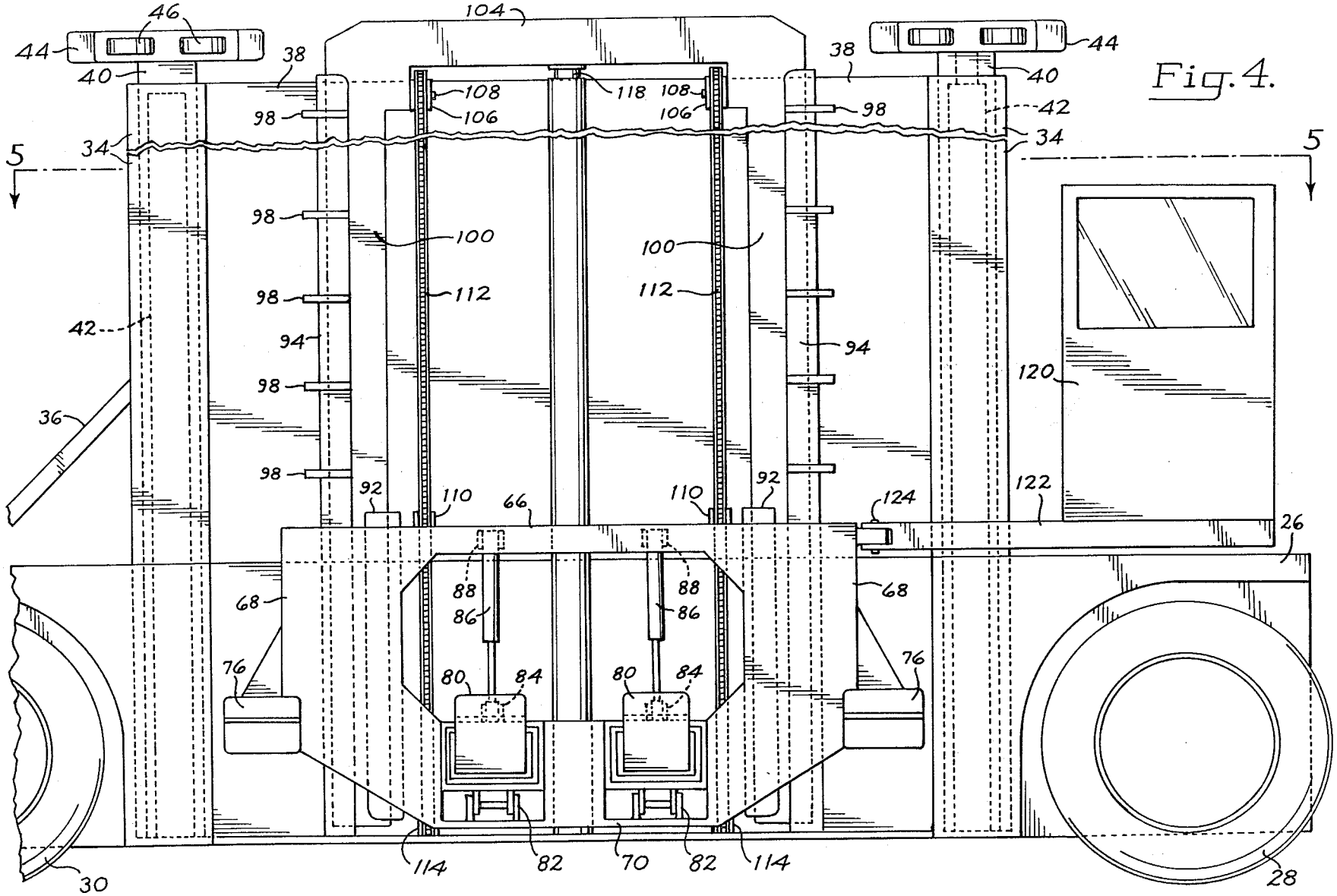
FIG. 4 is a fragmentary foreshortened side elevation of the mobile elevator showing the guide masts and elevator assembly.
Figure 5:
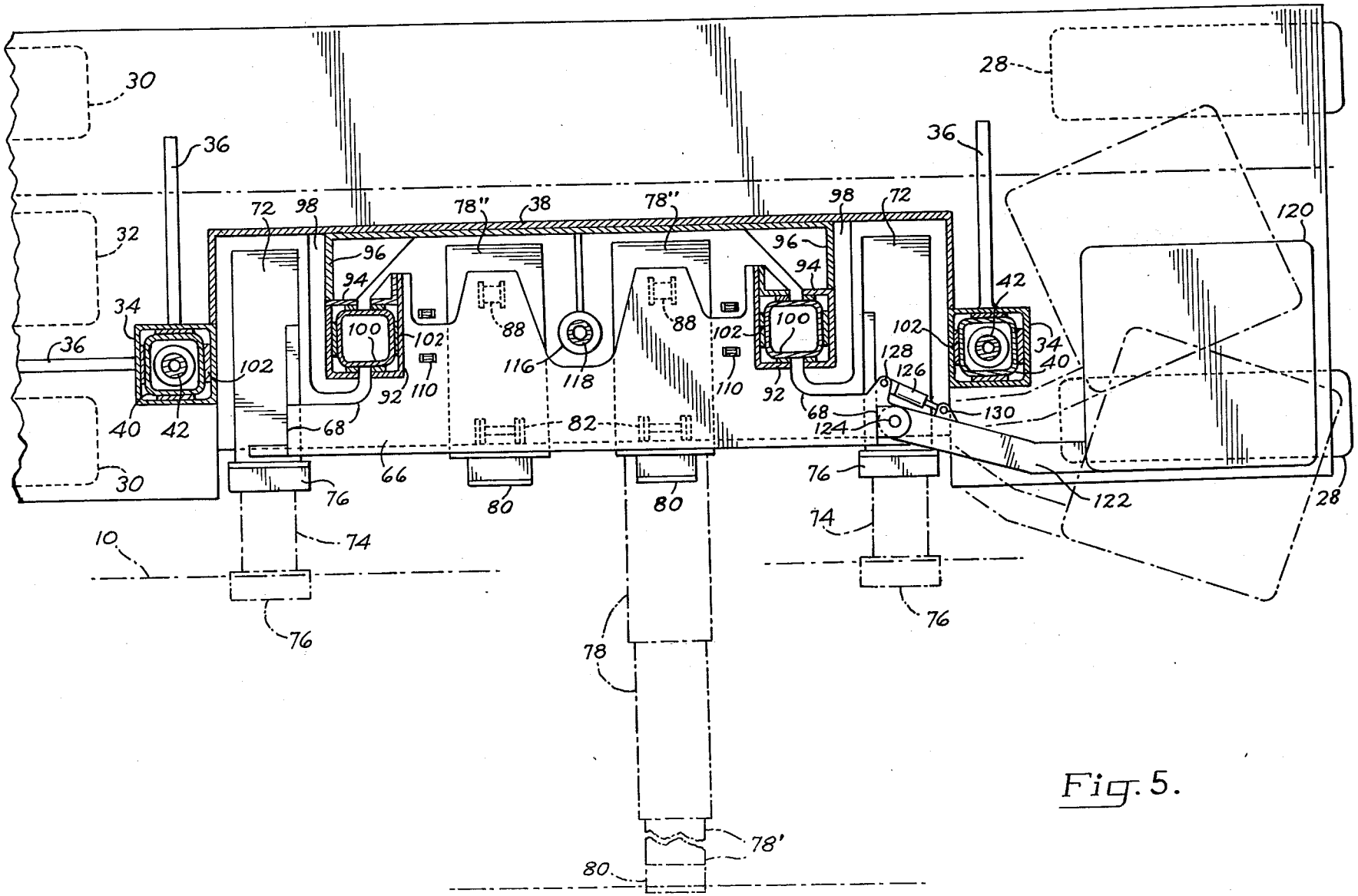
FIG. 5 is a fragmentary horizontal section taken on the line 5—5 in FIG. 4.

The storage system of this invention is intended for use primarily for the storage of cargo container trailers of the wheeled type. As illustrated, such trailers include a cargo container 10 supported at its rearward end by laterally spaced tandem wheels 12 and at its forward end by laterally spaced, vertically adjustable jack stands 14. A fifth wheel coupling (not shown) is provided at the forward end of the container for detachable connection to a tractor by which the trailer is moved over the roads to and from railroad flat cars upon which they are placed for long distance transport.

The storage system of this invention includes a storage structure for supporting a plurality of cargo container trailers. As illustrated, the storage structure includes a framework made up of a multiplicity of vertical beams 16 which are spaced apart longitudinally and laterally and are interconnected at their upper ends by longitudinal and transverse beams 18 and 20, respectively. The lower ends of the vertical beams preferably are anchored in the bottom floor of the structure. Conveniently, this floor may be provided by the concrete or macadam deck of the truck or railroad terminal at which the system is to be employed.

The storage structure is provided with a plurality of vertically spaced pairs of horizontally spaced floors upon which to support a plurality of trailers. In the embodiment illustrated, each floor is formed of a plurality of longitudinally spaced support pads 22 mounted on the vertical beams 16. The plurality of pads disposed in the same plane and in a single longitudinal row thus form an elongated floor. Adjacent pads serve to support longitudinally spaced portions of the trailer. In the embodiment illusted, each pair of adjacent pads are arranged to support the rear wheels 12 and front jack stands 14, respectively, of a trailer.

Laterally adjacent pairs of pads at each of the vertical levels terminate at their inner, confronting ends 24 in laterally spaced apart condition, to provide an elongated central passageway which extends the full length and vertical height of the assembly of adjacent pairs of floors.

The storage structure illustrated provides three sets of laterally spaced pairs of floors. The floors intermediate the outboard sides of the structure are formed of pads which extend laterally to opposite sides of the supporting vertical beams 16. It will be understood, of course, that the storage structure may be formed of but a single pair of laterally spaced floors, by limiting the width of the framework.

The storage system includes a powered vehicle comprising a chassis 26 supported on laterally spaced front and rear wheels 28 and 30, respectively, powered by an engine 32. The vehicle chassis mounts the lower sections 34 of a pair of vertically elongated, hollow telescoping stabilizer masts. To further secure the masts to the chassis, bracing 36 is anchored to the lower sections of the masts and to the chassis. Additional support is given by a wall 38 interconnecting the masts the full height of the lower sections, the wall being secured to the chassis behind the masts.

Each mast includes an elongated inner section 40 received telescopically within the outer section 34. The inner section of each mast is extendable vertically relative to the outer section by any well known conventional means. In the embodiment illustrated, a hydraulic piston-cylinder unit 42 is mounted within each mast, bearing at its upper end against the upper end of mast section 40. As the piston-cylinder unit is extended, the inner mast section is moved vertically upward. The limit of maximum extension of the mast assembly is reached when flanges (not shown) on the lower end of the inner mast section engage cooperating flanges of the upper end of the outer section.

Guide means is provided for supporting the upper ends of the extended stabilizer masts by the storage structure as the vehicle and mast assembly is moved through the central passageway between the laterally spaced floors. This prevents the elevator and vehicle assembly from tipping over when a cargo container trailer is lifted by the elevator, as explained more fully hereinafter. In the embodiment illustrated, a longitudinally elongated hollow housing 44 is affixed to the top of the inner section of each mast. The housing mounts a pair of longitudinally spaced guide rollers 46 for rotation about vertical axes 48.

The rollers project laterally beyond the opposite sides of the housing 44 for rolling contact with one of the other of the laterally spaced side walls of the elongated mast guide 50. As illustrated, the mast guide is substantially U-shaped in cross section and is secured to the underside of the transverse beams 20 of the storage structure. Each mast guide is disposed parallel to the associated longitudinal passageway defined between adjacent floors of the storage structure.

The mast guide projects beyond at least one of the longitudinal ends of the storage structure a distance sufficient to support the top housings 44 of the stabilizer mast while the vehicle is positioned outside the structure where it is capable of engaging and lifting a cargo trailer. The bottom sides of the mast guide 50 are flared outward to facilitate entry of the housing 44. A truss assembly 52 is provided to strengthen this outwardly projecting portion of each mast guide.

Since the mast assemblies are anchored rigidly to the chassis of the vehicle, lateral adjustment of the upper ends of the masts is provided through use of hydraulic jacks 54 (FIG. 6) anchored to the front and rear axles 56 of the vehicle. The jacks are connected to a source of hydraulic fluid under pressure in such manner as to provide for extension and retraction of each jack, and also to provide for free floating movement of each jack, as discussed hereinafter.

Figure 6:
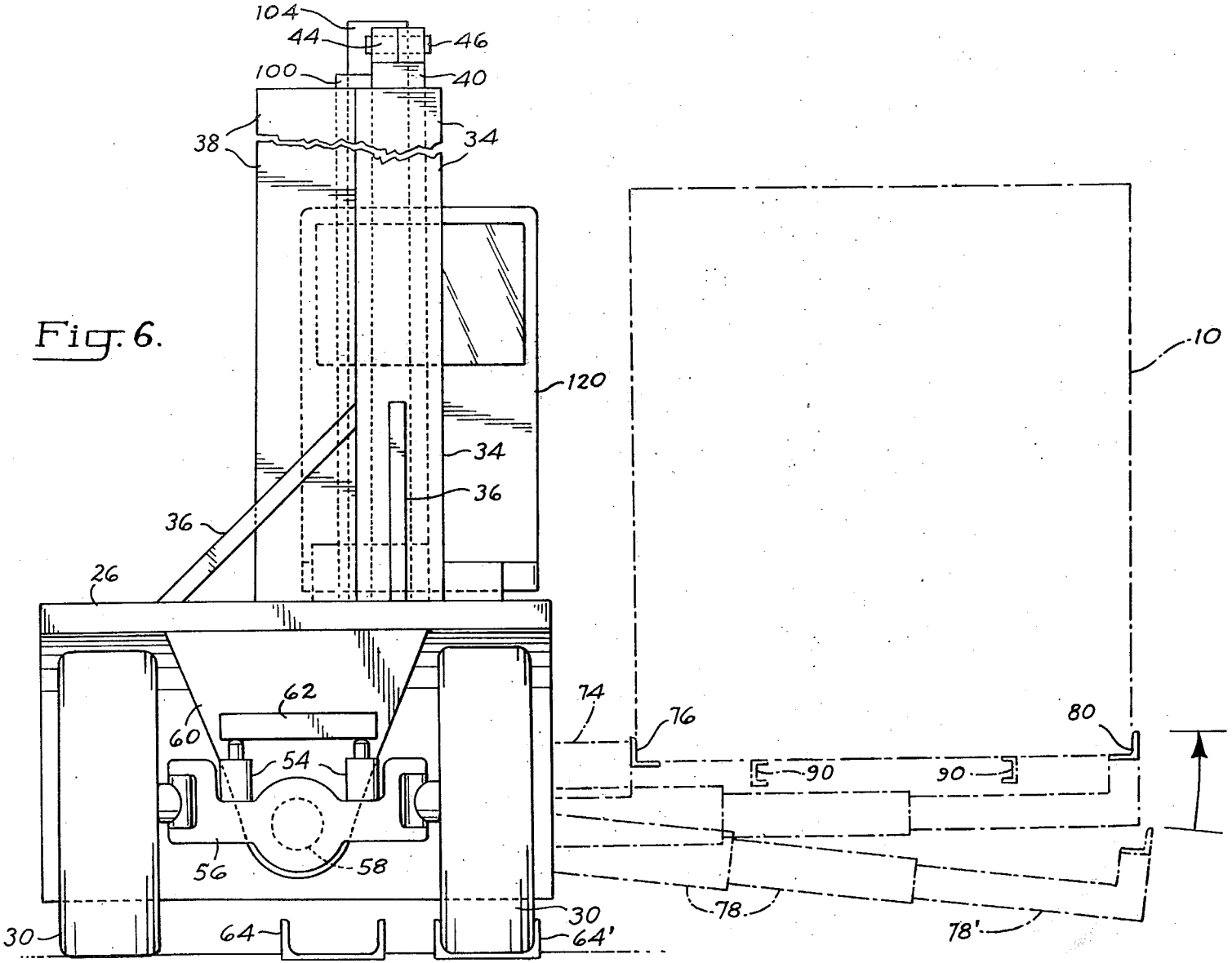
FIG. 6 is a foreshortened end elevation of the mobile elevator as viewed from the left in FIG. 4.

The chassis is mounted pivotally to each axle 56 by shaft 58 interconnecting the axle and the chassis support plate 60 at each of the chassis 26. As illustrated in FIG. 6 an abutment 62 is provided on each support plate 60 for the axle jacks to bear against. The primary weight of the vehicle rests on these jacks 54, thus relieving substantial stress on the shafts 58 and their support bearings. Extension or retraction of the jacks on one side of the longitudinal centerline of the vehicle provides lateral tilting of the chassis 26 and corresponding lateral tilting of the mast, to effect alignment of the mast guide housings 44 with the mast guide 50 of the storage structure.

Elongated U-shaped tracks 64, 64' are disposed parallel to each other along the ground adjacent each of the longitudinal passageways. Each of these tracks is arranged selectively to receive the front and rear wheels on one side of the vehicle. These provide three main functions: First, they serve to steer the vehicle as it moves along the passageway. Secondly, they assure approximate vertical alignment of the vehicle with the mast guides. Lastly, they provide a consistent path of movement along the passageway, thus assuring proper positioning of the cargo trailers on the pads.

Means for lifting a cargo container trailer is provided through use of an elevator on the vehicle positioned between the guide masts. The elevator includes a roof 66, sides 68, and a floor 70. The elevator mounts trailer support mechanism which, as illustrated, includes a pair of longitudinally spaced hydraulic end units, the cylinders of which are contained within the square tubings 72 anchored to the floor of the elevator. The piston rods of the units are contained in square tubings 74 which telescope within the tubings 72 and extend in the lateral direction of the vehicle for extension outwardly beyond the side of the vehicle and for retraction to a point adjacent and preferably within the margin of the side of the vehicle. The outer end of each piston rod tubing mounts an L-shaped bracket 76 configured to engage the confronting lower inner corner of a cargo trailer positioned adjacent the vehicle. This corner is defined by the bottom and side walls of the trailer.

Intermediate the pair of longitudinally spaced piston-cylinder end units is mounted a pair of hydraulic piston-cylinder center units. Each is confined in a plurality of telescoping square tubular sections 78 sufficient to extend laterally from a fully retracted position adjacent the side of the vehicle to a position adjacent the outer side of the trailer. The outermost telescoping sections 78' of the center units mount L-shaped brackets 80 configured to engage the outer bottom corner of a container trailer 10.

The innermost section 78'' of each center unit is mounted at its outer end, i.e. at the end adjacent the side of the vehicle, to the elevator floor on a pivot bearing 82. The opposite, inner end is connected by pivot 84 to the lower end of a vertically extending piston-cylinder unit 86. The upper end of each unit 86 is connected by pivot 88 to the roof of the elevator. Activating these units 86 provides vertical tilting of the sections 78 of the center trailer support units, as shown in broken lines in FIG. 6, sufficient for the brackets 80 to pass under the pair of laterally spaced, longitudinally extending reinforcing beams 90 that project downward from the floor of the container trailer.

Rigidly attached to the sides of the elevator are two U-shaped vertical slide tracks 92. Two complementing U-shaped slide tracks 94 are anchored to the chassis and wall 38 by side plates 96. Reinforcing braces 98 are provided for the plates 96.

Means is provided for raising and lowering the elevator. As illustrated, a pair of elevator lift masts 100 are disposed between the associated pair of slide tracks 92 and 94, for vertical movement relative thereto. Lubrication pads 102 are provided between the masts and slide tracks, and also between the stabilizing mast sections 34 and 40.

The elevator lift masts are connected together at their upper limits by cross beam 104. The cross beam mounts chain pulleys 106 supported rotatably on shafts 108 disposed in line with chain securing brackets 110 mounted on the elevator roof. Lifting chains 112 depend from the pulleys 106 and one stretch of the chains extend downward through openings in the elevator roof and floor and are secured to chassis brackets 114. The other stretch of the chains are secured to the chain brackets 110 located on the roof of the elevator.

Intermediate the center trailer support units 78 and centered under the elevator cross beam 104, openings are provided through the elevator roof and floor. The cylinder 116 of an elongated hydraulic piston-cylinder unit is rigidly mounted to the chassis 26 such that it extends vertically upward freely through the elevator. The piston rod 118 of said cylinder is anchored to the center of the underside of the cross beam 104, as illustrated.

An operator compartment 120 is secured to and movable with the elevator and contains the controls for operation of the mobile elevator. The compartment is secured to the elevator by pivot shaft 124. Lateral movement of the compartment is provided by an hydraulic piston-cylinder unit 126, one end of which is anchored to a pivot 128 on the elevator, the other end being anchored to a pivot 130 at a point on the arm 122. This provision of lateral movement of the compartment affords the operator full view of the loading and unloading operation as it is in progress.

The operation of the storage system described hereinbefore is as follows: With the stabilizer mast sections 40 fully retracted and the piston-cylinder units 74,78 also fully retracted, the vehicle is moved into proximity with the storage structure, longitudinally outward of the desired passageway between the horizontally spaced floors to be loaded with cargo container trailers. The mast sections 40 are then raised by extension of the hydraulic piston-cylinder units 42 until the longitudinal housings 44 are slightly below the elevation of the associated mast guides 50. The vehicle is maneuvered to engage the front and rear wheels at the appropriate side of the vehicle in the corresponding bottom guide track 64, or 64'. The vertical disposition of the mast sections 40 then is adjusted, by operation of the piston-cylinder units 42 and jacks 54, to bring the housings 44 into the guide track 50. The flared bottom opening of the guide track 50 in this area assists in this operation.

Jacks 54 now are adjusted to the floating condition referred to hereinbefore, to allow free pivotal movement of chassis 26 and elevator and mast assembly, to accommodate variations in the floor as the vehicle is moved into the storage structure.

With the container support units 72, 78 fully retracted, a cargo container trailer is moved into position closely adjacent the corresponding side of the vehicle (FIG. 1). This is achieved by operation of a tractor connected to the trailer, as will be understood.

The longitudinally spaced pair of piston-cylinder end units 72 are then extended laterally outward and, if necessary the elevator is raised, as required to bring the clamping bracket 76 into engagement with the bottom inboard corners of the container (FIG. 6). The center piston-cylinder units 78 may be tilted downwardly to provide clearance of the bottom of the trailer and then the center units are extended until the clamping brackets 80 at the outer end of the outer section are slightly outboard of the outer bottom corner of the container trailer. The center piston-cylinder units are then tilted upward to a horizontal position against the bottom outside corner of the trailer and retracted sufficiently to bring the brackets 80 into clamping engagement with the outboard corner of the trailer. The container thus is secured firmly by the four point supports of the two longitudinally spaced outboard brackets 80 and the two longitudinally spaced inboard brackets 76.

The elevator then is extended vertically upward by operation of the elevator piston-cylinder unit 116, 118 against the elevator cross beam 104. As will be understood, the elevator rises twice the distance as the elevator lifting assembly by the pulley arrangement of the chains. The elevator is raised until the container trailer is slightly above the level of the floor upon which it is to be deposited for storage. During this lifting operation, the mast and the vehicle supporting it is prevented from tipping over sideways, due to the weight of the container, by virtue of the support of the upper end of the mast 40 by the guide track 50 secured at the top of the storage structure. The vehicle then is driven into the storage structure to the desired position for deposit of the container. The operator then lowers the elevator sufficiently to deposit the wheels and jacks of the trailer upon the floor pads.

The container trailer engagement procedure is then reversed and the support cylinders are fully retracted to permit movement of the vehicle through the passageway of the storage structure preliminary to picking up a subsequent cargo container trailer.

When the elevated floors at one side of the storage unit have been filled with trailers, the vehicle is turned around, end for end, so that the support cylinders and clamp brackets face in the opposite lateral direction. The front and rear wheels on the same side of the vehicle are positioned in the other guide track located on the floor of the structure, to align the stabilizer mast with the mast guide 50. The elevated floors of the storage unit on that side of the passageway then may be filled with trailers, in the same manner as previously described.

With all of the elevated floors of a unit thus having been filled with trailers for storage, additional trailers may be stored at ground level, vertically below the elevated floors, simply by moving the trailers into the storage unit by means of a tractor.

It will be apparent to those skilled in the art that various changes may be made in the size, shape, type, number and arrangement of parts described hereinbefore, without departing from the spirit of this invention and the scope of the appended claims.

Having now described my invention and the manner in which it may be used, I claim:

1. A storage system for cargo container trailers, comprising:

(a) a storage structure having a bottom floor and at least one pair of elevated, horizontally elongated floors spaced apart horizontally to provide a longitudinal passageway therebetween, (b) a steerable, powered vehicle having front and rear pairs of wheels and maneuverable over the ground independently of and exteriorly of said storage structure, (c) vertically elongated mast means, extending upwardly from the vehicle, (d) elongated mast guide means on the storage structure above the elevated floors arranged to engage the upper end of the mast means for guiding movement of the mast means relative to the guide means, the guide means extending parallel to said passageway for movement of the mast means longitudinally through said passageway, and (e) elevator means mounted on the vehicle for vertical movement relative thereto, the elevator means including trailer support means extending retractably to one lateral side of the vehicle and arranged to releasably support a trailer for transport to and from said elevated floors.

2. The storage system of claim 1 including wheel guide track means on the bottom floor of the storage structure arranged for engagement of said wheels on one side of the vehicle for guiding the vehicle for movement of the mast means longitudinally through the passageway between the horizontally spaced floors.

3. The storage system of claim 2 wherein the mast guide means and vehicle wheel guide track means extend longitudinally beyond the elevated floors to support the mast means while the elevator supports the trailer longitudinally outward of said floors.

4. The storage system of claim 1 wherein:

(a) each elevated floor comprises a plurality of longitudinally spaced pads adjacent pairs of which are arranged to support longitudinal portions of a trailer, (b) guide track means is provided on the bottom floor of the storage structure arranged for engagement by said wheels on one side of the vehicle for guiding the vehicle for movement of the masts longitudinally through the passageway between the horizontally spaced floors, and (c) the mast guide means and vehicle guide track means extend longitudinally beyond the elevated floors to support the mast means while the elevator supports a trailer longitudinally outward of said floors.

5. The storage system of claim 1 wherein the vehicle includes front and rear axles, and pivot means interconnecting the axles and chassis for lateral tilting of the mast means relative to the guide means.

6. The storage system of claim 1 including an operator compartment mounted on the elevator means for vertical movement therewith and lateral adjustment relative thereto.

7. The storage system of claim 1 including pivot means mounting the trailer support means on the elevator means for pivoting the support means to allow unhindered passage of the support means under a trailer.

8. The storage system of claim 1 wherein the trailer support means comprises first telescopic fluid pressure cylinder means on the elevator extendable retractably to engage the outer side of a trailer to be supported, pivot means mounting the inner section of the first telescopic cylinder means on the elevator for vertical pivotal movement of the cylinder means to allow unhindered passage of the outer end of the cylinder under the trailer, and second telescopic fluid pressure cylinder means on the elevator extendable retractably to engage the inner side of a trailer to be supported.

* * * * *